United States Patent [19]

Chiba

[11] 4,116,193

[45] Sep. 26, 1978

[54] PRESSURIZED GAS OR AIR OPERATED REPEATER RIFLE

[75] Inventor: Kensuke Chiba, Tokyo, Japan

[73] Assignee: Sharp Rifle Company, Ltd., Japan

[21] Appl. No.: 746,722

[22] Filed: Dec. 2, 1976

[30] Foreign Application Priority Data

Dec. 27, 1975 [JP] Japan ..... 50-157064

[51] Int. Cl.[2] ..... F41B 11/02; F41B 11/06

[52] U.S. Cl. ..... 124/72; 124/51 R; 124/53; 124/74; 124/76

[58] Field of Search ..... 124/40, 45, 51 R, 52, 124/53, 66, 67, 68, 69, 70, 71, 72, 73, 74, 75, 76, 77; 42/17, 23, 24

[56] References Cited

U.S. PATENT DOCUMENTS

| | | | |
|---|---|---|---|
| 398,130 | 2/1889 | Cooper et al. | 42/24 |
| 1,057,171 | 3/1913 | Redfield | 124/67 |
| 1,677,810 | 7/1928 | Bond | 124/51 R |
| 2,312,244 | 2/1943 | Feltman | 124/72 |
| 3,474,560 | 10/1969 | Ramsay | 42/17 |

FOREIGN PATENT DOCUMENTS

| | | | |
|---|---|---|---|
| 161,760 | 7/1905 | Fed. Rep. of Germany | 42/17 |
| 488,872 | 1/1954 | Italy | 124/72 |
| 520,623 | 3/1955 | Italy | 124/72 |
| 519,141 | 3/1955 | Italy | 124/72 |
| 485,350 | 10/1953 | Italy | 124/51 R |

*Primary Examiner*—Richard T. Stouffer

[57] ABSTRACT

A pressured gas or air operated repeater rifle which enables safe and accurate firing regardless of the rapidity of firing. A barrel of the rifle is provided with a bolt arranged slidably in a bore and a carrier which is positioned so as to extend through the bore at horizontal right angle to the bolt and to be slidable in the barrel and which is in freely sliding contact with a magazine opening at horizontal right angle to the direction of the magazine chamber. The carrier is provided with a lateral through hole at a position to match the opening of the magazine when the carrier shifts to the magazine side, and also to match the bore when it shifts in the direction opposite to the magazine side. An operation bar which connects the bolt with an operation bar handle on the cylinder is provided. Reciprocating movement of the carrier is provided by a mechanism positioned in the gap between the bolt and the hammer chamber arranged above and below. This mechanism allows positive loading of one pellet in the magazine by one reciprocating motion of the operation lever. Further, the repeater rifle includes a mechanism which permits starting and stopping of feeding of a pellet to the bore from the magazine depending on pressure in the cylinder, a mechanism for preventing imperfect operation by checking rearward and forward movements of the operation bar at the forward and rearward positions of the same, a mechanism for preventing explosion during operation, and a push screw construction which allows outward discharge of gas.

7 Claims, 14 Drawing Figures

1
2
18
19
4
5A
49
6
5
3
44A
43A
7
8
42
43B
44B
40B
45
39
26
25
A
41B
B
C
D
E
24
28
27
33
36
32
35
34
31
37
38
23
29
22
30
21
51
50
40A
41A
14
20
46
13
12
48
47
10
10A
11
15
17
16
57
56
9

56
9
54
2
1
J
47
4
5A
3
61
7
54
59
55
60
8
5
58
42
45
39
25
J

PRESSURIZED GAS OR AIR OPERATED REPEATER RIFLE

BACKGROUND OF THE INVENTION

The present invention relates to a pressured gas or air operated repeater rifle having a gun barrel and cylinder arranged in parallel with the axial line of the barrel and a mechanical seat supporting the above, which is capable of storing in the cylinder pressurized gas for firing a projectile.

There have been no more than two or three types of pressured gas or air operated guns capable of firing pellets in rapid succession in the world. In all these cases, however, undue strain has been imposed on the pellet feeding mechanism, which in combination with deformation of the pellets resulted in poor hits. These also have not been provided with any double loading preventing mechanism, giving rise to trouble that made firing impossible because of multiple pellet loading. These further have been attended with the danger of explosion during rapid firing.

SUMMARY OF THE INVENTION

One object of the invention is to provide a pressured gas or air operated repeater rifle provided with a pellet loading mechanism which obviates the above-mentioned defects and which permits positive loading of one pellet in the magazine by one reciprocating motion of the operation bar.

Another object of the invention is to provide a pressured gas or air operated repeater rifle having a mechanism which permits automatic stopping of feeding of pellets when the firing pressure drops and which prevents double loading or multiple loading due to pressure drop of gas.

A further object of the invention is to provide a pressured gas or air operated repeater rifle having a mechanism which definitely prevents explosion even when rapid firing operation is performed with the trigger kept pulled.

A further object of the invention is to provide a pressured gas or air operated repeater rifle having a mechanism which prevents erroneous operation or double loading.

A further object of the invention is to provide a pressured gas or air operated repeater rifle having a mechanism which does not allow firing even when the trigger is pulled during rapid firing operation or prevents misfiring by performing direction determining control during rapid firing operation of one reciprocating movement.

A still further object of the invention is to provide a pressured gas or air operated repeater rifle having a push screw construction which allows outward discharge of gas.

BRIEF DESCRIPTION OF THE DRAWINGS

Other and further objects of the invention will become apparent from the following description taken in connection with the accompanying drawings wherein.

DESCRIPTION OF THE PREFERRED EMBODIMENTS

Figure 1:
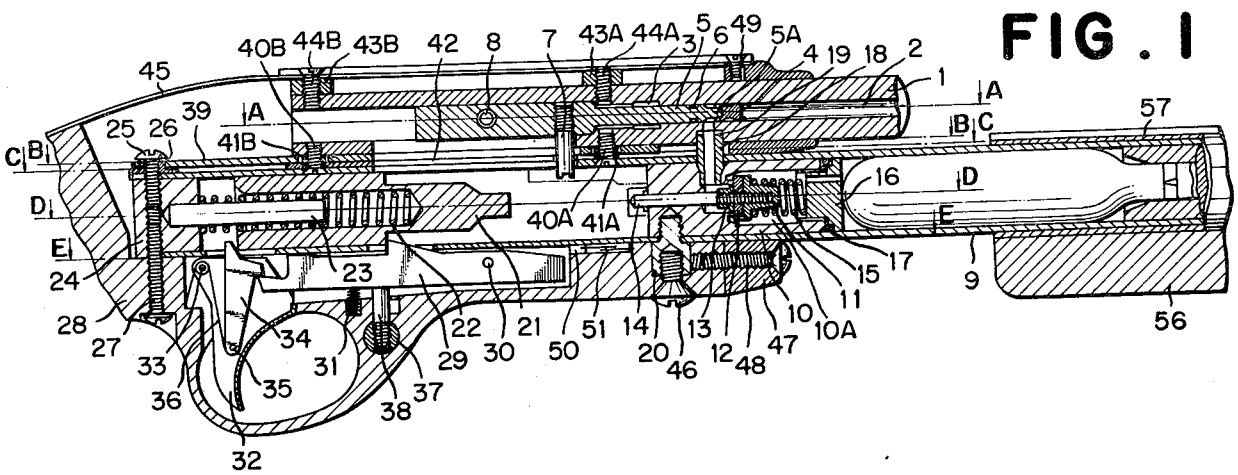
FIG. 1 is a longitudinal vertical sectional view of the main mechanisms.

FIG. 1 represents a longitudinal sectional view of the principal mechanisms of the present invention. Gun barrel 1 is provided with carrier 3 which moves horizontally at right angle to bore 2, and bolt 5 loads pellet 4 into bore 2 through the pellet feeding hole provided for carrier 3. Bolt 5 has an elongated protrusion 5A which is so built that its tip pushes the center of pellet 4 when it is loaded and which makes possible firing of pellet 4 by means of high-pressure gas that gushes out of exhaust pipe 18, and at the rear thereof is bolt O-ring 6 which prevents rearward leak of the high-pressure gas, at the rear of which is provided vertical bolt nock 7 which is linked to hammer 21 when bolt 5 makes a rearward motion and which is also so arranged as to be connected with connector 55 by means of connecting pin 8. The bolt casing of barrel 1 has an opening that allows rearward movement of bolt nock 7 and connecting pin 8, and cylinder 9 connected to barrel 1 is also provided with an opening so that bolt nock 7 and hammer 21 may operate in concert.

The rear main mechanism unit of cylinder 9 is provided with valve housing 10 which forms valve chamber 10A, exhaust valve seat 11 firmly embraces valve 12 and together with valve seat pressing metal 13 it is fixed by means of valve rod 14 which runs through bolt, and valve rod 14 protrudes rearward through the shaft sliding hole of valve chamber 10A.

Valve spring 15 is positioned between valve cap 16 screwed on in front of valve chamber 10A and valve assembly 11–14 and is mounted so that the valve adheres to the circular protrusion valve seat inside valve chamber 10A in order to maintain airtightness. The tension of valve spring 15 is adjusted so that the valve will open by means of the added tension of hammer spring 22 when the pressure of the high-pressure gas in the valve chamber 10A becomes inadequate to fire a pellet. Further, a vent is provided for valve chamber cap 16 to link it up with the cartridge chamber of cylinder 9 and also O-ring for chamber cap 17 is provided so as to sustain airtightness from the cartridge chamber side of cylinder 9. The valve unit 10–17 runs through cylinder 9 via exhaust pipe 18 at the rear of the valve seat of valve chamber 10A, and the exhaust pipe meets the rear opening of bore 2 when the pellet is loaded via exhaust pipe O-ring 19, and when the exhaust valve opens, the pressure of the high-pressure gas is applied to pellet 4, setting it against cylinder 9 by means of valve housing setting screw 20.

The rear portion of valve housing 10 of cylinder 9 constitutes the hammer chamber so as to allow movement of hammer 21. Hammer spring 22 is prevented from bending by means of spring guide 23 fixed on cylinder back stop 24 and is positioned between cylinder back stop 24 and the internal hole of hammer 21 to cause forward movement of hammer 21 which strikes the rear portion of valve rod 14 so as to open valve seat 12.

Cylinder back stop 24 is set, on one hand, by means of setting screw 25 that passes through the hole provided in eccentric ring 26 that serves as axis of carrier lever 39 and cylinder 9 and, on the other, it is set together with cylinder 9 and frame 28 by means of rear setting screw 27.

Sear 29 in the internal casing of frame 28 is pushed upward by sear spring 31 with sear pin 30 used as the pivot and, passing through the opening of the hammer chamber unit of cylinder 9, engages with the stair portion of hammer 21 and compressing hammer spring 22, prevents forward movement of hammer 21 that has moved rearward. Also, safety post 38 of safety button 37 suppresses the movement of sear 29 bringing about the safety lock-applied state at the time preparations for firing are completed. The rear portion of sear 29 also engages with trigger sear 34 linked with trigger 32, and as trigger 32 with trigger pin 33 as pivot and trigger sear 34 with trigger sear pin 35 linked with trigger 32 as pivot are pushed forward by means of trigger spring 36, the rear end of sear 29 and trigger sear 34 maintain their engaged state. Also, when hammer 21 moves rearward beyond the position where sear 29 is engaged, trigger sear 34 is pushed rearward by the rear end of trigger 21 and detaches from engaging with sear 29, but when hammer 21 moves forward to the position where it correctly engages with sear 29, trigger sear 34 moves forward pushed by trigger spring 36 and engages with the rear end of sear 29.

Safety button 37 is provided in the hole that horizontally runs through the regular position in front of the trigger guard of frame 28, and safety post 38 planted in it undergoes horizontal movements to stop, when necessary, movements of sear 29 where safety post 38 is engaged by trigger 21.

Carrier lever 39 and bolt lock lever 42 are positioned between bolt casing of barrel 1 and the hammer chamber of cylinder 9. These operate by means of rearward and return movements of connector 55 mounted on operation bar 54, connecting pin 8 attached to the connector and also bolt 5 linked with the connecting pin and the bolt nock provided for the bolt. Carrier lever 39 is linked with carrier 3 and causes horizontal movements of carrier 3 using an eccentric ring as the pivot. Commencement time of the horizontal movements can be adjusted by means of the eccentric ring.

When connector 55 is at the forward regular position, bolt lock lever 42 is pushed by bolt lock lever spring 42B and stops rearward movement of bolt nock 7, and while connecting pin 8 linked with bolt 5 passes the long round hole 55A of connector 55, the check is released before rearward movement is transmitted to bolt 5 from connector 55. Bolt lock lever 42 operates with spacer 41B of rear barrel setting screw 40B as pivot.

Barrel setting screws 40 A and B are set through spacers 41 A and B so as to maintain correct spacing between barrel 1 and cylinder 9. Cover setting screws 44 A and B set cover 45 and barrel 1 via cover spacers 43 A and B.

Front set screw 46 sets frame 28 and cylinder 9, front cover 47 sustains barrel 1 and cylinder 9 and are set on frame 28 by means of front cover set screw 48. Cover side set screw 49 sets cover 45 and front cover 47.

Sear lock 50 is bent in L shape, and its one end meets the lower portion of cylinder 9 at the sear lock casing of frame 28 and is sustained so as to operate back and forth, and when connector 55 moves rearward from its regular forward position, it enters between the upper front end of sear 28 and cylinder 9 by means of sear lock spring 51, thus limiting the movements of sear 29.

Figure 2:
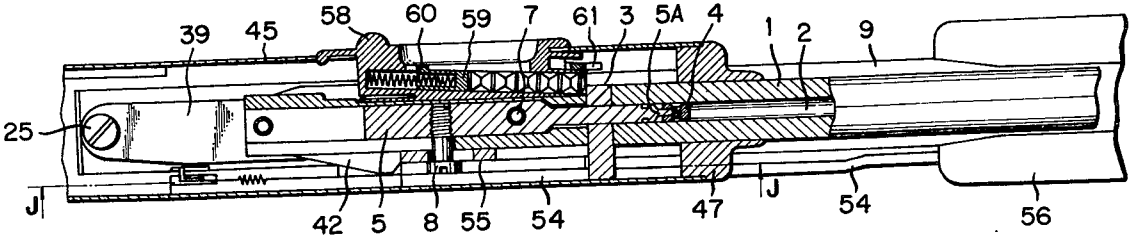
FIG. 2 is a longitudinal horizontal sectional view of the A—A portion indicated by arrows in FIG. 1.

FIG. 2 is a horizontal longitudinal sectional view of A—A indicated by arrows in FIG. 1. Connector 55 is mounted on operation bar 54 and is linked with bolt 5 through the long round hole of connector 55 having space for back-and-forth movement of connecting pin 8. The forward portion of operation bar 54 is linked with operation tube 57 and operation tube 57 is so arranged to undergo back-and-forth movement along the periphery of cylinder 9. Operation bar handle 56 is mounted on the outer side of operation tube 57 to facilitate the above movement as well as supporting of the gun.

Magazine 58 is in contact with the rear face of carrier 3 and is fitted into the groove provided on the left side of bolt casing of barrel 1. It is also so arranged as to be feasible to mounting and demounting through the square hole found in cover 45, and magazine 58 is provided with magazine follower 59 and follower spring 60 so as to push the pellets housed in magazine chambers 58 A to N, and the head of the first pellet 4 is held down with the carrier.

Figure 3:
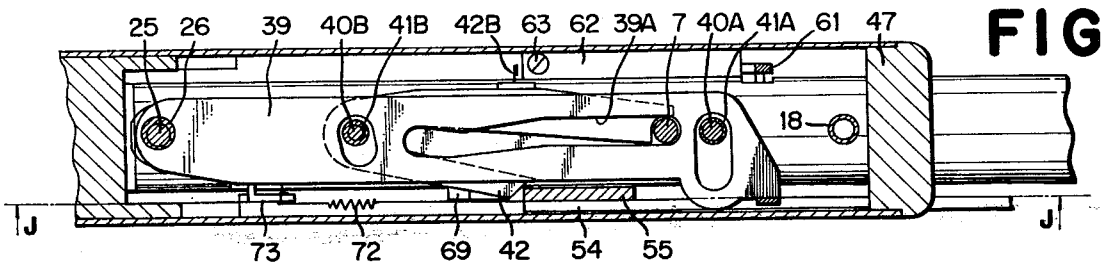
FIG. 3 is a longitudinal horizontal sectional view of the B—B portion indicated by arrows in FIG. 1.

FIG. 3 is a horizontal longitudinal sectional view of B—B indicated by arrows in FIG. 1. It shows the relation of carrier lever 39 found between barrel 1 and cylinder 9 and bolt nock 7 that operates the carrier lever. The right side end of carrier lever 39 is bent upward in L shape and is fitted into the groove provided for carrier 3.

Carrier lever 39 is fitted into eccentric ring seat 26, and using setting screw that runs through it as pivot, sliding groove 39A is provided to allow carrier lever 39 to move horizontally by means of the rearward movement of bolt nock 7. The portion that obstructs this movement and the portion that knocks against it are avoided by means of the long round hole.

The sliding groove does not undergo linear motion until bolt nock 7 attached to bolt 5 moves rearward till the forward tip of bolt 5 retreats to the rear of carrier 3. From this point the sliding groove is curved so that bolt nock 7 moves carrier lever 39 leftward. As a result, carrier lever 39 works leftward and carrier 3 linked with it also moves leftward to match magazine chambers 58–N of magazine 5 and the shot holes of carrier 3, thus making carrier 3 stationary for a time. At this juncture, the first shot of pellet 4 housed in magazine chambers 58–N of magazine 58 enters the shot hole of carrier 3.

When bolt nock 7 begins return motion, carrier 3 admits one pellet into its shot hole and shifts rightward while holding down the head portion of the second pellet in the magazine chamber, stops at the point where the shot hole and bore 2 match, and the front end protrusion of bolt 5 loads pellet 4 into bore 2 while pushing the center of the hole found on the rear portion of pellet 4. By repeating this motion pellets 4 housed in magazine chambers 58–N of magazine 58 are successively loaded into bore 2.

As eccentric ring 26 serves as the pivot for carrier lever 39, movement commencement time of carrier 3 can be adjusted by changing the eccentric position.

Figure 4:
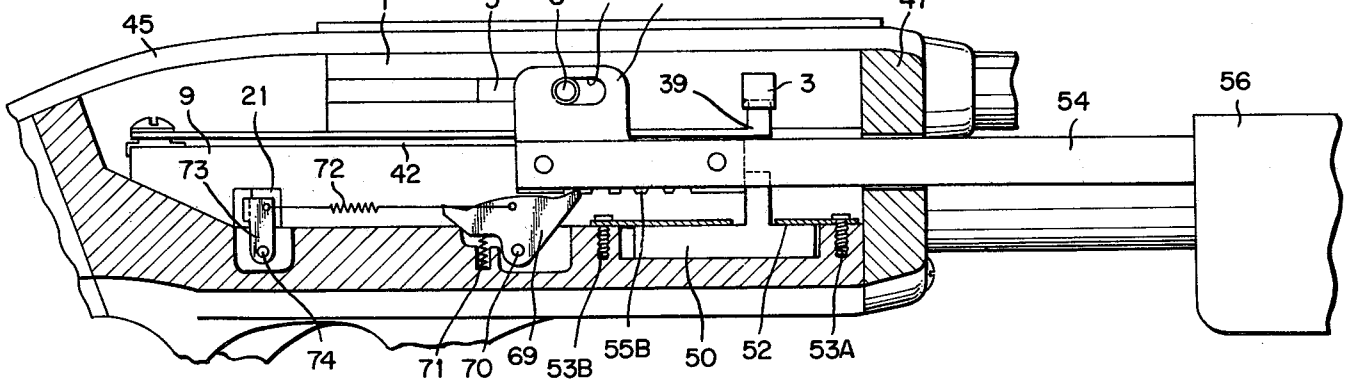
FIG. 4 is a longitudinal vertical sectional view of the J—J portion indicated by arrows in FIG. 2 and of the J—J portion indicated by arrows in FIG. 3.

FIG. 4 is a vertical longitudinal sectional view of J—J indicated by arrows in FIG. 2. Operation bar handle 56, operation tube 57 mounted with the operation bar, operation bar 54 mounted on operation tube 57 and connector 55 mounted on the operation bar undergo rearward and return movements through the groove of frame front cover 47. This connector 55 is linked to bolt 5 by means of connecting pin 8 that runs through long round hole 55A. The front edge of connector 55 is in contact with sear lock 50 at the correct forward position, and when connector 55 moves rearward, that portion of sear lock 50 that is bent in the sear lock casing in frame 28 (see FIG. 8) is pushed by sear lock spring 51 provided therein and enters between the front end of sear 29 and cylinder 9.

Rack gear 55B is provided on the under surface of connector 55. This rack gear engages with the front ratchet of pawl 69 to check rearward movement of operation bar 54, while it also engages with the rear ratchet of pawl 69 so as to check forward movement of operation bar 54.

Pawl 69 is provided with front ratchet and rear ratchet protrusions; it is linked with frame 28 by means of pawl pin 70 and undergoes slight rotary motion. Also, pawl spring 71 is provided so as to push the rear ratchet upward, and it is also linked with actuator 73 by means of actuator spring 72.

Actuator 73 is linked with frame 28 by means of actuator pin 74 and its one end, being bent in L shape, operates when it touches hammer 21 as it moves rearward through the hole provided in the hammer chamber of cylinder 9, thus pulling pawl 69 via actuator spring 72 and causing the front beak of pawl 69 to lock with rack gear of connector 55 thereby permitting forward movement of connector 55 but checking its rearward movement.

When this actuator 73 does not touch hammer 21, pawl spring 71 pushes the rear ratchet of pawl 69 to make it engage with the rack gear, thereby permitting rearward movement of connector 55 but checking its forward movement.

Figure 5:
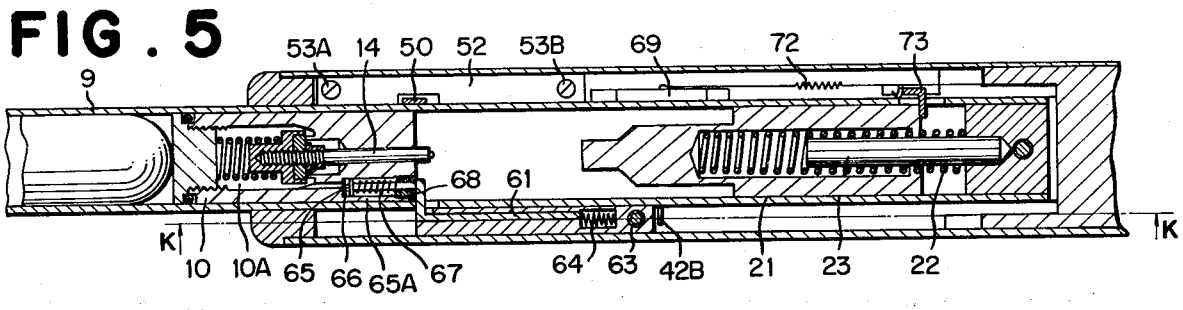
FIG. 5 is a longitudinal horizontal sectional view of the D—D portion indicated by arrows in FIG. 1.

FIG. 5 is a horizontal longitudinal sectional view of D—D shown by the arrows in FIG. 1. Controller piston 65 is provided in parallel with valve rod 14 of valve housing 10 fixed on cylinder 9, and a small through hole is made from valve chamber 10A. In the controller cylinder are provided controller piston 65 for maintaining airtightness by means of O ring for controller piston 66 and piston spring 67 around the shaft linked to the controller piston, and having run piston rod guide 68 through the shaft of controller piston 65, the piston is supported, under normal pressure, as if it is being pushed towards valve chamber 10A.

One end of magazine controller 61 that runs through the hole provided in cylinder 9 is positioned as if touching the shaft tip of controller piston 65 while its rear end is provided with controller spring 64. This spring is housed in controller casing provided for frame 28.

Sear lock 50 is housed in the sear lock casing of frame 23 and it is set by means of set plate set screws 53 A and B as if being supported by sear lock set plate having a groove for movements.

Figure 6:
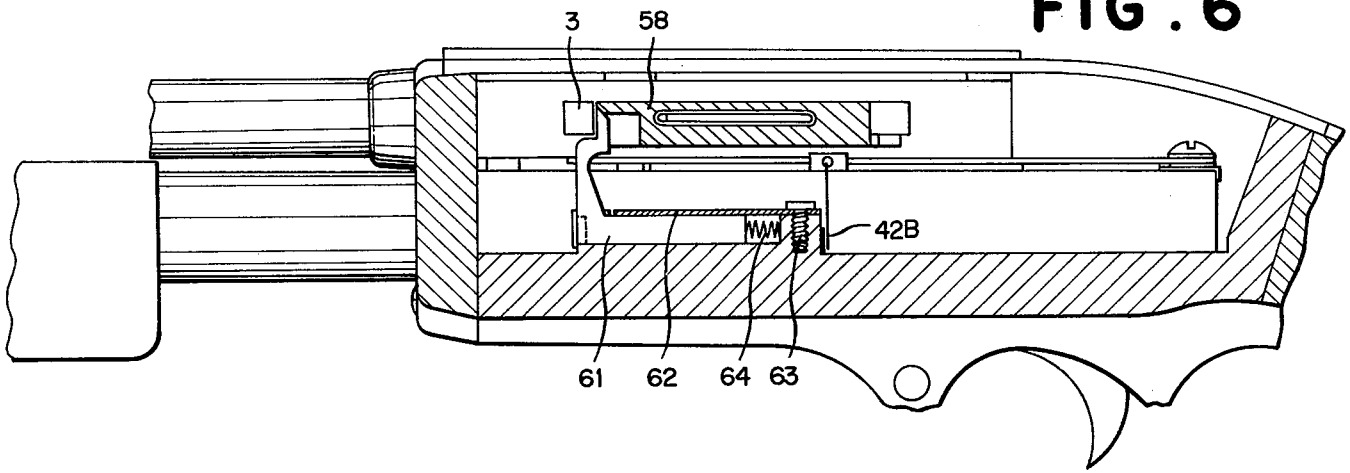
FIG. 6 is a longitudinal vertical sectional view of the K—K portion indicated by arrows in FIG. 5.

FIG. 6 is a vertical longitudinal sectional view of K—K shown by arrows in FIG. 5. One end of magazine controller 61 is in contact with the shaft of controller piston while the other end is held down by controller spring 64, and the protrusion on still another end is in contact with stop 58D which forms a unit with projectile holding paw 58–C of magazine 58 (see FIG. 10) which is mounted so as to avoid obstructing movements of carrier 3 in such a manner as to push them upward when rearward movement of controller piston 65 takes place.

Figure 7:
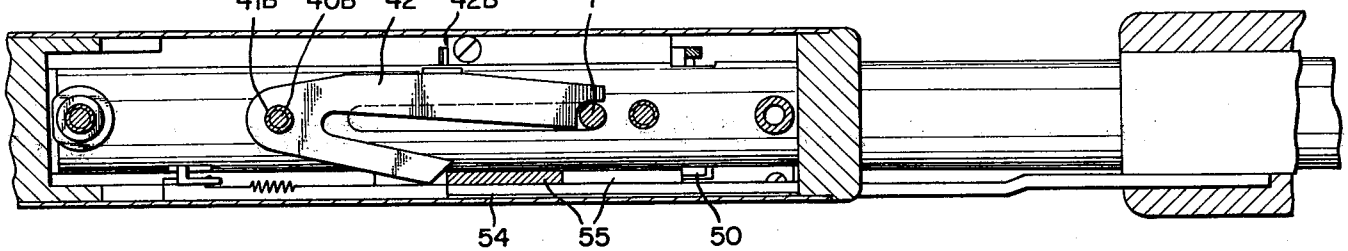
FIG. 7 is a longitudinal horizontal sectional view of the C—C portion indicated by arrows in FIG. 1.

FIG. 7 is a horizontal longitudinal sectional view of C—C indicated by arrows in FIG. 1. Bolt nock lever spring 42 is forked with its one end checking rearward movement of bolt nock 7 and the other being arranged so as to undergo rotary movement using spacer ring 41 of rear barrel setting screw 40 as pivot as if sliding against connector 55. The space between the two ends is such as to allow rearward movement of bolt nock 7 without obstruction.

Figure 8:
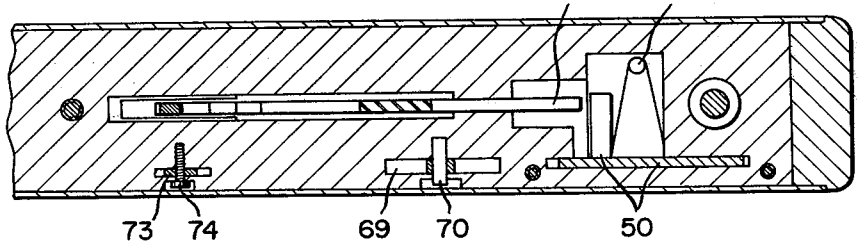
FIG. 8 is a longitudinal horizontal sectional view of the E—E portion indicated by arrows in FIG. 1.

FIG. 8 is a horizontal longitudinal sectional view of E—E indicated by arrows in FIG. 1. L-shaped sear lock 50 is pressed against the sear lock casing provided for frame 28 by sear lock spring 51, and the figure shows the upward protrusion of sear lock 50 for the case of connector 55 being at regular forward position. If connector 55 moves rearward now, sear lock 50 is pushed by sear lock spring 51 and the horizontal protrusion of sear lock intervenes between sear 29 and cylinder 9, checking the movement of sear 29 and the intervention being released when connector 55 returns to its regular position.

Figure 9:
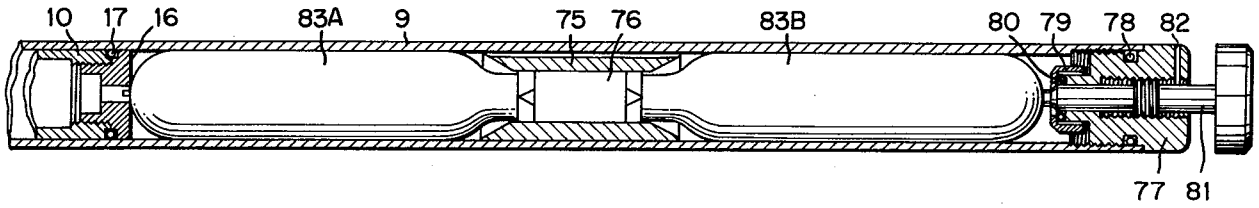
FIG. 9 is a longitudinal vertical sectional view of the first half of the 2-cylinder section in FIG. 1.

FIG. 9 is a vertical sectional view of the portion for housing gas cartridges 83A and B found in the frontward portion of valve chamber 10A of cylinder 9. Cylinder cap 77 is screwed on to the thread provided on the internal wall of the front end of cylinder 9 and airtightness is maintained by means of front cap O-ring 78. Opener 81 having knurl on the front end, screw thread on the middle, one-stage taper on the rear end and flat surface on the rear portion is screwed on to cap O-ring 77, and under the state of thrusting opener 81 into cylinder 9 by turning it, airtightness is maintained by means of O-ring for grand nut 80 which is supported by the shaft portion and grand nut 79. Also, for preventing opener 81 from dropping off cylinder cap 77, opener stopper 82 is provided. Further, if, as shown in the figure, needle 76, which has needle-like protrusions on both end supported in the middle with needle holder 75, is placed so as to match the sealing plates of two gas cartridges 83A and B, and opener 81 is made to move ahead spirally, the sealing plates of two gas cartridges 83A and B are broken through by needle 76 and the high-pressure gas or liquefied gas sealed in the gas cartridge becomes high-pressure gas and fills the interior of cylinder 9 and valve chamber 10 and is held there.

For safely discharging and discarding the high-pressure gas filling cylinder 9, opener 81 is spirally moved rearward so that a gap between O-ring for grand nut 80 will be made at the tapered portion, losing airtightness. The high-pressure gas can then be safely discharged from the slight gap arising at the screwed joint between opener 81 and cylinder cap 77. Opener stopper 82 is provided so as to prevent the screwed joint of opener 81 and cylinder cap 77 from dropping out.

Figure 10:
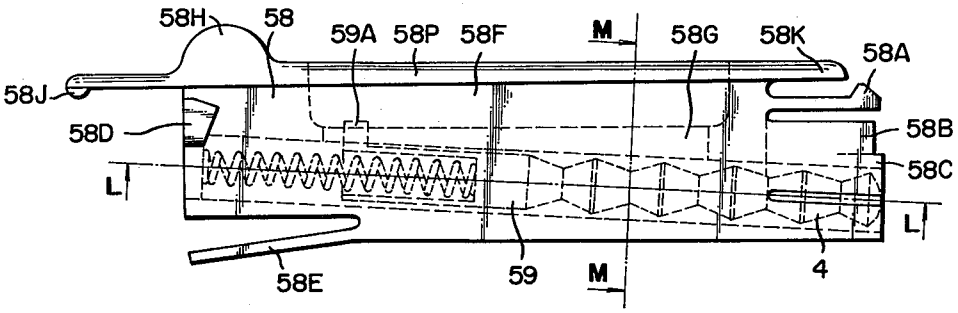
FIG. 10 is a view of the upper face of the magazine 58 shown in FIG. 2.
Figure 12:
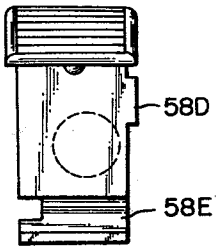
FIG. 12 is a rear side view of FIG. 10.
Figure 14:
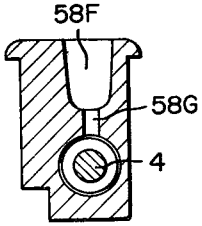
FIG. 14 is a transverse vertical sectional view of the M—M portion indicated by arrows in FIG. 10.
Figure 11:
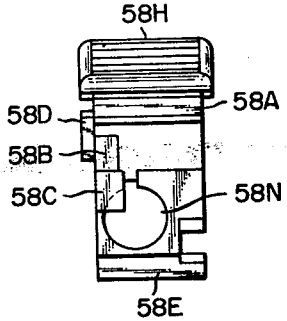
FIG. 11 is a frontal side view of FIG. 10.
Figure 13:
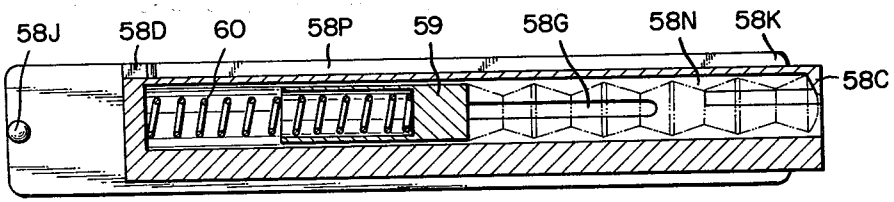
FIG. 13 is a longitudinal vertical sectional view of the L—L portion indicated by arrows in FIG. 10.

FIG. 14 is a vertical cross-section view of M—M indicated by arrows in FIG. 10. It gives details of the hard plastic discrete unit of magazine 58 which is freely mountable and demountable.

This magazine 58 houses five pellets 4 and at its rear are magazine chambers 58N which house magazine follower 59 and follower spring 60. At the rear portion of magazine follower 59 is pellet number indicating point 59A protrusion, and this slides along the pellet number indicating groove 58G to indicate the number of pellets in magazine 58. In order to facilitate seeing the pellets, it is provided with wide opening 58F towards outside.

Magazine controller tongue 58B and magazine control pawl 58C are found in the forward portion of magazine 58, and as a channel is provided on each side of these and the lower portion is vacant or a channel is provided for the portion contacting magazine chamber 58N, a leaf spring-like strip is formed, and magazine control pawl 58C's pawl projects into magazine chamber 58N so that pellets 4 being pressed by magazine follower 59 and follower spring 60 do not drop off. When this is mounted on a gun and magazine controller 61 interlocked with controller piston 65 operates, magazine controller tongue 58B, etc., which are built as a unit with it, are pushed upward, and when pellet 4 in magazine chamber 58N matches with the shot hole of carrier 3, it is pushed into the shot hole. Also, when the pressure in valve chamber 10A drops, magazine controller 61 returns and magazine controller tongue 58B and magazine control pawl 58C are restored to their original state by the elasticity of the hard plastic, thus allowing the pawl of magazine control pawl 58C to enter magazine chamber 58N to stop discharge of pellet 4.

To mount magazine 58 on the gun, magazine 58 held upper face up is inserted sidewise into the rectangular space capable of accommodating setting thumb mound 58H prvided on the left side of cover 45 and magazine 58, and putting a finger on finger notch 58H, it is pushed forward while pressing against barrel 1 to wedge the forward portion of the rectangular hole of cover 45 between forward holder 58K and forward push pawl 58A. The pawl of forward push pawl 58A then operates so as to press magazine 58 conversely against barrel 1.

At this time sideward thrust 58E is pressed and magazine 58 assumes the original width, cover 45 is pinched in the channel between pincer stop 58D and outer plate 58P, and when magazine 58 is moved forward till locking catch 58J is settled in the setting hole provided for cover 45, magazine 58 adheres closely to the channel provided for the left side of the bolt casing of barrel 1, thereby mounting the magazine on the specified position between cover 45 and barrel 1.

When magazine 58 is to be taken out of the gun, pushing finger notch 58H rearward makes sideward thrust 58E to work as a leaf spring which pushes the rear portion of magazine 58 out of cover 45, thus making it easy to take it out.

Now, using a high-pressure stored air or gas operated repeater rifle thus constructed, when cylinder cap 77 is unscrewed, needle 76, which is supported by needle holder 75 is loaded with gas cartridges 83A and B in its middle, cylinder cap 77 is screwed on and opener 81 is moved spirally forward as if being pushed, needle 76 breaks through the sealing plates of gas cartridges 83A and B, and the sealed gas fills cylinder 9 and valve chamber 10A and pushes controller piston 65. During the operation the gas is prevented from leaking outside by means of rings for various parts, such as O-ring for cap sealing 17, O-ring for cap 78, O-ring for grand nut 80 and O-ring for controller piston 66, and valve 12.

When controller piston 65 is pushed, magazine controller 61 is pushed, and as its one end pushes up magazine controller tongue 58B of magazine 58, and it pawl releases check imposed on pellet 4 in magazine chamber 58N of magazine 58, the first shot of pellet 4 stops with its head against carrier 3.

Here, when operation bar handle is moved rearward with the hand that holds it, connector 55 linked to it makes bolt nock lever 42 work to release check on bolt nock 7. At the same time, sear lock 50 moves rearward, and intervening between sear 29 and cylinder 9, limits the movement of sear 29, thus preventing explosion during rearward and forward movements. Next, as connecting pin 8 is moved rearward by the forward end of the long round hole of connector 55, bolt 5 and the bolt nock linked to it also move rearward, and hammer 21 links up with bolt nock 7 and moves rearward while compressing hammer spring 22. Meanwhile, when end protrusion 5A of bolt 5 passes through the shot hole of carrier 3, carrier lever 39 begins to move, pawl 69 is pushed upward by pawl spring and carrier 3 linked to it begins to shift leftward. Pawl 69 is pushed upward by pawl spring 71 and its rear ratchet engages with the rack gear provided on the under side of connector 55, permitting rearward movement of the part linked up with connector 55, thus checking forward and return movements.

If the rearward movement continues further, sear 29 is pushed upward by sear spring 31 to stop forward movement of hammer 31, and sear lock 50 intervening deeper between the front end of sear 29 and lower side of cylinder 9, checks the movement of sear 29. Meanwhile, the shot hole of carrier 3 coincides with magazine chamber 58N of magazine 58 and admits one pellet into the shot chamber.

If rearward movement continues further, the rear end of hammer 21 touches one end of trigger sear 34 and pushes it so as to release the engagement with sear 29, while at the same time pushing actuator 73 backward. Consequently, pawl 69 linked with it by means of actuator spring 72 is pulled, and its front ratchet engages with the rack gear of connector 55 to check rearward movement, thus permitting forward and return movements.

Also, even when rearward movement of the portion linked to connector 55 is executed while keeping trigger 32 pulled, the time sear lock 50 checks the movement of sear 29 is merely delayed till trigger sear 34 is released from engagement with sear 29 by the rearward movement of hammer 21 and sear 29 and hammer 21 link up in an engaged manner; all other operations remain the same. When forward and return movements are assumed next, hammer 21 moves forward somewhat, and becoming completely engaged by sear 29, it stops. Trigger sear 34 also tips forward as it is pushed by trigger spring 36, and engages with sear 29 thus maintaining linkage. Meanwhile, carrier lever 39 and carrier 3 linked thereto begin a movement reverse to rearward movement because of the effect of bolt nock 7. Carrier 3 houses pellet 4 in its shot hole and operates while holding down with its flat surface the head of the foremost pellet among the pellets remaining in magazine chamber 58N of magazine 58.

If forward and return movements are continued further, carrier 3 coincides with the center line of the shot hole and stops, and forward end protrusion 5A of bolt 5 pushes the tail end of the pellet housed in the shot hole of carrier 3 and the tip of bolt 5 runs through this shot hole and loads the pellet into bore 2. Immediately prior to the completion of forward and return movements, the front side of connector 55 pushes sear lock 50 to release movement check of sear 29 while at the same time bolt nock lever 42 assumes a position so as to check the rearward movement of bolt nock 7 by means of bolt lock lever spring, thus completing pellet loading and preparations for firing. As, at this time, actuator 73 is guided behind hammer 31, rearward movement of connector 55 and so forth is prevented till hammer 21 moves forward by the firing operation, thus preventing erroneous operation or double loading and maintaining the state of firing by pulling trigger 32.

Further, in case the pressure in cylinder 9 becomes inadequate for firing the projectile, or an unforeseen drop in pressure takes place, controller piston 65 is moved back by piston spring 67, magazine controller 61 is also pushed by controller spring 64, and magazine controller tongue 58B of magazine 58 and magazine controller pawl 58C forming a unit with it hold down the head of the foremost pellet in magazine chamber 58N to check projectile feeding, thereby preventing double loading or multiple loading arising from pressure drop, and if projectile firing pressure should be inadequate, due to balance between trigger spring 22 and valve spring 15, valve seat 12 automatically opens to discharge gas remaining in cylinder 9. Also, in case this reciprocating movement is stopped during operation, no firing is possible even when subsequent continuous movement direction is determined or the firing operation is executed while the trigger is kept pulled unless trigger 32 is once released, because no linkage can be established between trigger sear 34 and sear 29. In case a pellet 4 is loaded in the bore, double loading is absolutely impossible since rearward movement of the portions linked with connector 55 is checked by pawl 69.

As described in the foregoing, the present invention provides world's first absolutely safe and perfect high-pressure gas or air operated repeater rifle provided with mechanisms for absolute prevention of double loading, prevention of explosion during operation, automatic discharge and projectile feeding check at the time of gas pressure drop in the cylinder or discharge of gas in the cylinder when not needed.

While the described embodiment represents the preferred forms of the present invention, it is to be understood that modifications will occure to those skilled in that art without departing from the spirit of the invention. The scope of the invention is therefore to be determined solely by the appended claims.

What is claimed is:

1. A pressurized gas or air operated repeater rifle having a barrel provided with a bolt which is slidable within a bore therein, a cylinder positioned in parallel with the axial line of the barrel, a hammer chamber within said cylinder, and a mechanical seat supporting the barrel and cylinder, said repeater rifle being capable of storing pressurized gas in the cylinder for firing pellets, characterized by a magazine having at least one chamber that can be loaded or unloaded on the side of the barrel, pellets housed in the magazine chamber being normally yieldingly urged towards an opening of the magazine by means of a spring; said bolt having a bolt nock that projects into said hammer chamber at the lower portion of the barrel, a carrier positioned so as to extend through said bore at horizontal right angle to said bolt, said carrier being slidable in said barrel, said carrier also being in freely sliding contact with said magazine opening at horizontal right angle to the direction of said magazine chamber, said carrier being provided with a lateral through hole at such position adapted to match the opening of said magazine when said carrier shifts to the magazine side to admit one pellet from the magazine chamber, and also adapted to match the bore when it shifts in the direction opposite to the magazine side, so that the bolt that has moved forward passes through said hole to load forward a pellet housed in it, an operation bar that connects said bolt with an operation bar handle mounted for freely sliding movement on said cylinder; and movement means for causing reciprocating movement of said carrier by reciprocating movement of said operation bar, said movement means positioned between said bolt and said hammer chamber allowing movement of a pellet from the magazine through the carrier to said bore upon one reciprocating motion of the operation bar.

2. A repeater rifle as set forth in claim 1, said movement means comprising a carrier lever in the form of a plate which is pivotally connected at the rear end to the rear portion of the cylinder and engaged at the forward end by the bottom surface of said carrier, said carrier lever being provided at the central portion with a sliding groove which is passed through by the bolt nock freely movable in forward and rearward directions, said sliding groove being formed with a bend so that said bolt nock moves said carrier lever and carrier linked thereto so as to match the through hole of the carrier with the magazine chamber and bore, respectively, upon reciprocating motion of the bolt nock.

3. A repeater rifle as set forth in claim 1 further comprising an exhaust valve means including a valve case in the cylinder forming a valve chamber having pressurized gas which communicates with the bore, and a valve rod which is arranged freely movable through the wall of the valve case positioned between the valve chamber and the hammer chamber provided at the rear of the valve chamber, and which is yieldingly urged towards the hammer chamber by means of a spring; a piston which is positioned so as to be freely movable in a passage running through said wall and yieldingly urged towards the valve chamber by means of a piston spring; a magazine controller positioned for sliding movement adjacent to the piston at the opposite side of the valve chamber so as to bias the piston by means of spring; said magazine having a flexible tongue that projects somewhat across the opening of the magazine chamber to keep the pellet set normally, said magazine controller being provided with a protrusion for releasing the pellet by pressing the tongue at the opening of said magazine chamber when the magazine controller is actuated under sufficient pressure exerted by the pressurized gas on the piston to overcome the force of the piston spring and move the magazine controller into a position where the pellet may be released.

4. A repeater rifle as set forth in claim 1, wherein are provided a hammer which is positioned in a freely slidable manner in the hammer chamber of the cylinder and which is biased towards the valve chamber by means of a spring; a sear pivotally connected to the mechanical seat adjacent to the hammer chamber, said sear having a first protrusion for preventing forward movement of said hammer and a second protrusion at the rear end, and said sear being biased so that the first protrusion projects into the hammer chamber by means of a spring; a trigger pivotally connected to the mechanical seat at the rear side of said sear; a trigger sear which is pivotally connected to the trigger so as to be pivoted on it and which is biased so as to be engaged by the second protrusion at the rear end of said sear by means of a spring; a sear lock positioned adjacent to the front end of said sear, whereby said sear lock permits the front end of the sear to be locked so as to prevent the first protrusion of the sear from coming off the hammer when the hammer is in rearward position while at the same time releasing the sear operatively at the correct forward position of the operation bar handle.

5. A repeater rifle as set forth in claim 1, wherein are provided a pawl which is pivotally connected to the mechanical seat in the state of being biased toward one direction by means of a first spring at a position adjacent to the operation bar, said pawl having two tongues for stopping the operation bar from rearward and forward movements at the respective predetermined forward and rearward positions of the operation bar, and an actuator which is connected with the pawl through a second spring so as to bias the pawl in the direction opposite to the direction the pawl is biased by means of said first spring and which is pivotally connected to the mechanical seat so that the hammer, when moved rearward, causes said pawl to rotate against the biasing force of said first spring, thereby preventing imperfect operation through checking of rearward and forward movements of the actuator member at the forward and rearward positions of the actuator member.

6. A repeater rifle as set forth in claim 4, wherein are provided a pawl which is pivotally connected to the mechanical seat in the state of being biased towards one direction by means of a first spring at a position adjacent to the operation bar, said pawl having two tongues for stopping the operation bar from rearward and forward movements at the respective predetermined forward and rearward positions of the operation bar, and an actuator which is connected with the pawl through a second spring so as to bias the pawl in the direction opposite to the direction the pawl is biased by means of said first spring and which is pivotally connected to the mechanical seat so that the hammer, when moving rearwardly, causes said pawl to rotate against the biasing force of said first spring, thereby preventing imprefect operation through checking of rearward and forward movements of the actuator member at the forward and rearward positions of the actuator member.

7. A repeater rifle as set forth in claim 1, wherein a push screw is threadably connected to a front cover mounted on the forward end of the cylinder, in an airtight state by means of a sealing body for releasing the pressurized gas into the cylinder, and a portion smaller in diameter than the internal diameter of the sealing body is formed ahead of the axial section where the push screw is sealed, thereby allowing outward discharge of gas by means of rearward movement of the push screw.

* * * * *

UNITED STATES PATENT AND TRADEMARK OFFICE

CERTIFICATE OF CORRECTION

PATENT NO. : 4,116,193

DATED : September 26, 1978

INVENTOR(S) : Kensuke Chiba

It is certified that error appears in the above-identified patent and that said Letters Patent are hereby corrected as shown below:

At Column 8, line 34, - "31" should be -- 21 --;

At Column 9, line 12, - "31" should be -- 21 --;

At Column 12, Claim 6, line 17, - "imprefect" should be --imperfect --.

Signed and Sealed this

*First* Day of *May 1979*

[SEAL]

*Attest:*

RUTH C. MASON
*Attesting Officer*

DONALD W. BANNER
*Commissioner of Patents and Trademarks*